US005832845A

United States Patent [19]

Wagner

[11] Patent Number: 5,832,845

[45] Date of Patent: Nov. 10, 1998

[54] EQUIPMENT FOR MOLECULAR DECOMPOSITION OF HAZARDOUS WASTES USING A MOLTEN MEDIA REACTOR

[76] Inventor: Anthony S. Wagner, 713 Mariner, Lakeway, Tex. 78758

[21] Appl. No.: 704,307

[22] Filed: Oct. 15, 1996

Related U.S. Application Data

[63] Continuation-in-part of Ser. No. 328,270, Oct. 3, 1994, Pat. No. 5,564,351, which is a continuation-in-part of Ser. No. 319,640, Oct. 7, 1994, Pat. No. 5,452,671, which is a continuation-in-part of Ser. No. 225,612, Apr. 11, 1994, Pat. No. 5,461,991, which is a continuation-in-part of Ser. No. 221,521, Apr. 19, 1994, Pat. No. 5,553,558, which is a continuation-in-part of Ser. No. 103,122, Aug. 19, 1993, Pat. No. 5,359,947, which is a continuation-in-part of Ser. No. 982,450, Nov. 27, 1992, Pat. No. 5,271,341, which is a continuation-in-part of Ser. No. 669,756, Mar. 15, 1991, Pat. No. 5,167,919, which is a continuation-in-part of Ser. No. 524,278, May 16, 1990, Pat. No. 5,000,101.

[51] Int. Cl.[6] ..... F23G 7/00

[52] U.S. Cl. ..... 110/237; 110/235; 588/201

[58] Field of Search ..... 110/235, 346, 110/237; 588/201; 423/210.5, DIG. 12; 422/184.1

[56] References Cited

U.S. PATENT DOCUMENTS

| | | | |
|---|---|---|---|
| 5,301,620 | 4/1994 | Nagel et al. | 110/235 X |
| 5,431,113 | 7/1995 | Wagner | 110/237 |
| 5,555,822 | 9/1996 | Loewen et al. | 110/237 |

*Primary Examiner*—Henry A. Bennett
*Assistant Examiner*—Susanne C. Tinker
*Attorney, Agent, or Firm*—Joseph F. Long

[57] ABSTRACT

A modular system using molten aluminum alloy for degradation of wastes to innocuous molecular products using a central molten alloy heat source unit and separate reactor units for differing wastes. The molten alloy is pumped to the reactor units and returns by gravity flow to the central heat source which is maintained at about 850 to 950 degrees centigrade.

3 Claims, 4 Drawing Sheets

EQUIPMENT FOR MOLECULAR DECOMPOSITION OF HAZARDOUS WASTES USING A MOLTEN MEDIA REACTOR

BACKGROUND OF THE INVENTION

This application is a continuation-in-part of Ser. No. 08/328,270, filed Oct. 3, 1994, U.S. Pat. No. 5,564,351 which in turn is a continuation-in-part as shown in the following series:

Ser. No. 08/319,640 filed Oct. 7, 1994 U.S. Pat. No. 5,452, 671 which is a continuation-in-part of Ser. No. 08/225,612, filed Apr. 11, 1994 U.S. Pat. No. 5,467,991, which is a continuation-in-part of Ser. No. 08/221,521, filed Apr. 19, 1994 U.S. Pat. No. 5,553,558, which is a continuation-in-part of Ser. No. 08/103,122 Aug. 19, 1993 U.S. Pat. No. 5,359,947 which is a continuation-in-part of Ser. No. 07/982,450 Nov. 27, 1992 U.S. Pat. No. 5,271,341 which is a continuation-in-part of Ser. No. 07/669,756 Mar. 15, 1991 U.S. Pat. No. 5,167,919 which is a continuation-in-part of Ser. No. 07/524,278 May 16, 1990 U.S. Pat. No. 5,000,101.

There continues to be a need for disposing of a wide variety of hazardous wastes in an environmentally desirable manner. The most desirable manner may well be to break down the waste to totally innocuous products and most desirably to useful recyclable products in molecular or atomic form.

The present invention differs from the patents outlined in the above series in that molten aluminum alloy is recirculated from one or more reactor vessels or units to a central molten alloy heating source. There is a further difference in the liquid and slurry waste reactor that is now designed to give maximum diffusion of vaporized products that form bubbles to secure maximum interfacial contact with the molten alloy and thereby insure complete reaction.

SUMMARY OF THE INVENTION

A modular system with one or more molten aluminum treatment reactors co-operating with a molten alloy melting and heating unit to allow circulating molten aluminum alloy from the molten alloy melting and heating unit to the molten alloy treatment reactors. Each of the treatment reactors may be equipped to feed a particular type waste while maintaining the total system essentially oxygen free. A reactor equipped for feeding a liquid or slurry type waste and a reactor for feeding a boxed hazardous waste is shown.

An off gas treatment system is shown that uses:

a) a cyclone separator as an aqueous scrubber to scrub the off gas to remove particulates and condensibles and separate the gas from the scrubbing liquid;

b) a strainer or continous filter to separate particulates from the scrubbing liquid;

c) a cooler to cool filtrate from the filter; and d) recycle of the cooled filtrate through spray nozzles to quench the high temperature off gas and cool below 100 degrees centigrade before the gas-liquid stream enters the cyclone separator.

DETAILED DESCRIPTION OF THE INVENTION

The invention may best be described from the drawings.

Figure 1:
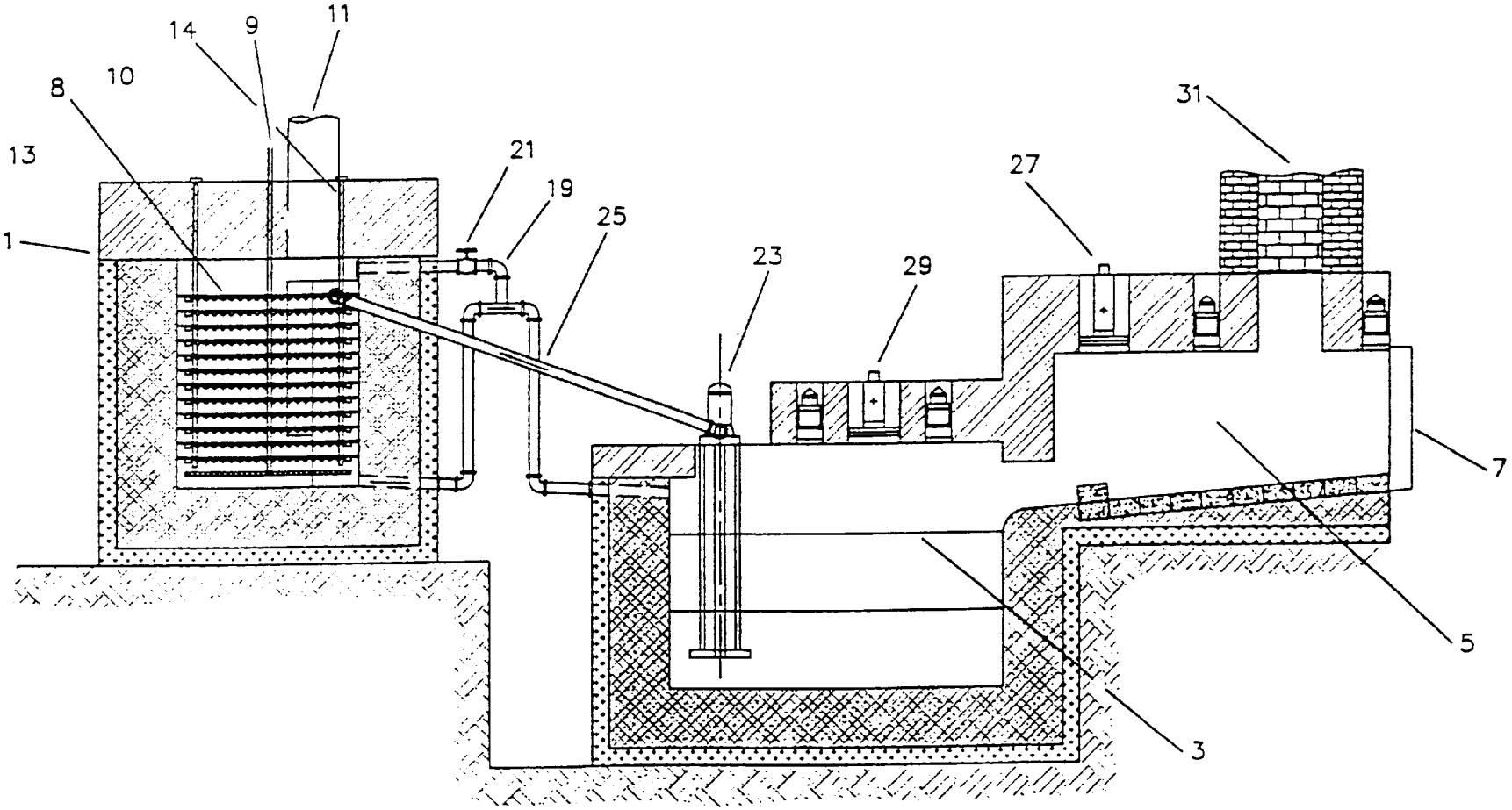
In FIG. 1 a side view of the major components of the equipment is shown.

In FIG. 1 a section view of the major equipment is shown. Reactor unit 1 is firebrick lined and as shown is equipped for liquid waste feed. Feed tube 9 extends through the removable top 10, is preferably located near one side of the reactor and terminates with a curved end to allow effluent gases or liquids to exit under the first of a series of diffuser or baffle plates 15. An inert gas purge with argon being preferable is either introduced with feed or through a separate feed line (not shown). The reaction is carried out in the absence of oxygen or with the minimum amount of oxygen. Thus there is not only the minimum amount of off gas to treat but formation of undesirable products with oxygen such as dioxanes is prevented. The feed tube 9 and the baffle plates 15 may be either ceramic or graphite. The baffle plates are suspended using ceramic rods or ceramic coated steel rods 14. The molten aluminum alloy 3 is quite reactive at the 750 to 950 degree centigrade temperature that is used for near total degradation and is best contained in a non metal type container. The composition of the aluminum alloy may be as follows:

50–100 percent aluminum

0–20 percent calcium

0–50 percent zinc

0–20 percent iron

0–50 percent copper.

The aluminum alloy 8 is held at a constant level with inverted siphon 19 when valve 21 is open. With valve 21 closed the alloy will siphon into the molten alloy heating unit 3. The bottom of molten alloy in reactor 1 should be above the top level of the alloy in the molten alloy heating unit 3. The inverted siphon lines and line leading to and including valve 21 should be heated and insulated to maintain a temperature of over 750 degrees centigrade. Line 25 leading from the submersed molten metal pump 23 should also be heated and insulated to maintain about 750 degrees centigrade temperature. All transfer or circulating lines should also be loosely encased to protect personnel from molten alloy in the event of line failure.

Figure 5:
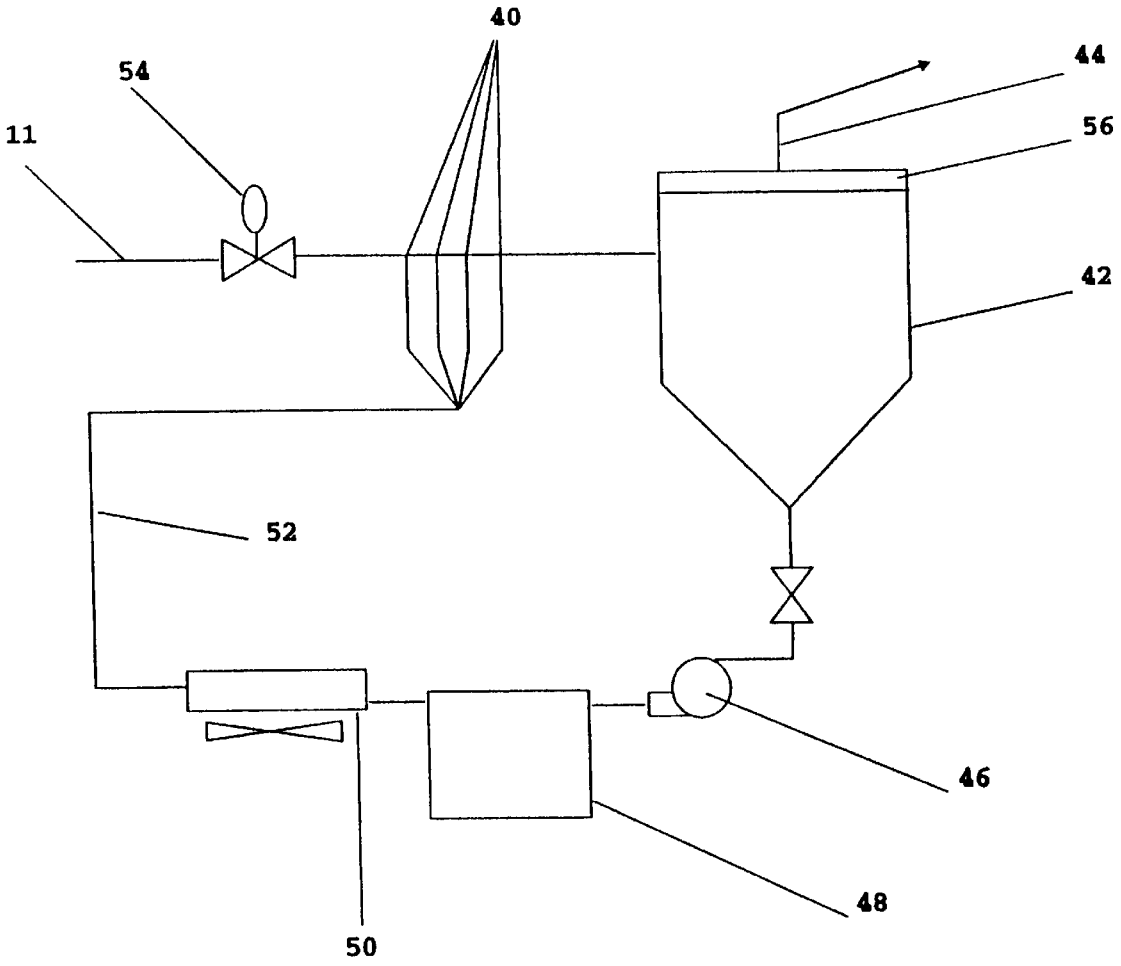
FIG. 5 shows an off gas handling system for handling off gas from a large variety different wastes.

The molten alloy heating unit 3 may be made quite large and both reactor 1 as shown for liquid feed and reactor 2 for boxed waste feed as shown in FIG. 5 may be connected to one molten alloy heating unit. Of course a third or even a fourth reactor unit (not shown) could be connected or available to be connected to the heating unit 3 depending upon the needs of the particular site.

In unit 3 one molten alloy pump is shown in FIG. 1 and this one pump may be used for both circulation and, by changing the discharge line, for pumping part or all of the alloy out of the unit when the alloy dissolves sufficient metals from the waste being treated that the composition changes to have a melting point near the 750–800 degree centigrade range. When two reactor units are used dual molten alloy pumps would be necessary.

Burners 29 are located above the molten metal so that the metal is heated without direct flame contact. The airhydrocarbon mixture entering the burner is adjusted to maintain a minimum of excess oxygen to essentially prevent oxidation of the alloy.

Chamber 5 with burners 27 is used to melt solid alloy charged through charging door 7 to provide alloy makeup by gravity flow into unit 3. Exit flue gas line 31 may be brick lined or fabricated from high temperature steel. Flue gas may be vented to the atmosphere.

Figure 2:
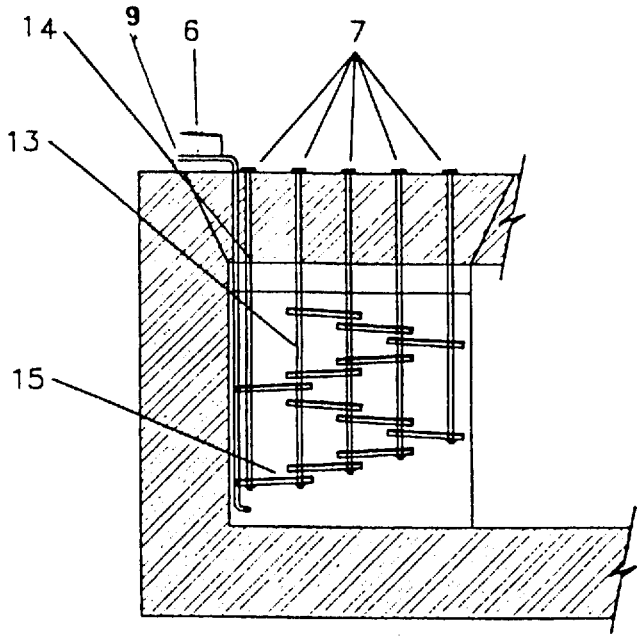
In FIG. 2 the diffuser unit to secure maximum interfacial contact is shown.

In FIG. 2 more detail of the diffuser or baffle plate unit 13 is shown. Feed tube 9 is shown near the side of the reactor to allow having the baffle plate 13 to be the maximum size. Inert gas purge line 6 ties into the feed tube to make certain that at the instant feed flow is stopped that the gas purge empties the tube to prevent carbonaceous plugging. Argon is the preferred inert gas for purging. The feed tube terminates with a curved end to allow bubbles formed to be caught under the first tilted baffle plate 15 and to travel upward to the next in the series of baffle plates as shown with the bubbles being flattened, rolled, and reformed to give the maximum interface for reaction of the contents of the bubbles and the molten alloy. The baffles may extend the full width of the reactor and are held in place with multiple suspension rods 14. These rods may ceramic, ceramic coated steel or graphite and may be held in place with ceramic pins.

Figure 3:
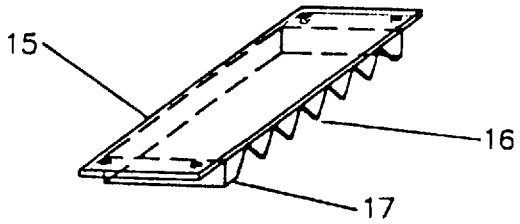
FIG. 3 shows a detail of a bottom portion of each diffuser plate.

FIG. 3 a baffle plate 15 is shown with containment ring 17 and longitudinal corrugations 16 on the underside of each baffle to secure changing interface as the bubbles travel upward to finally exit through the off gas line 11, FIG. 1.

Figure 4:
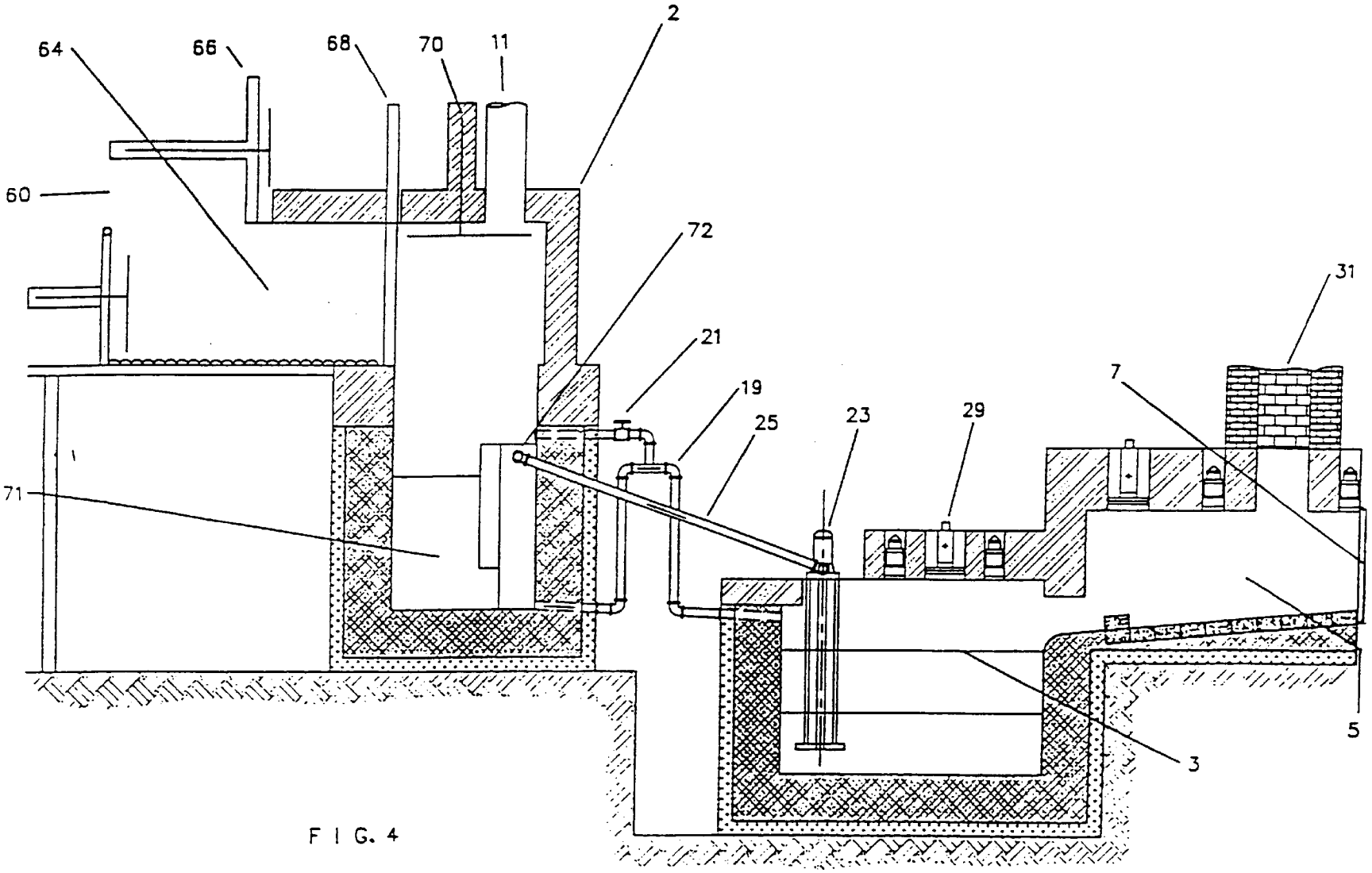
FIG. 4 shows a reactor and box feed system for treatment of boxed hazardous waste.

FIG. 4 shows a reactor 2 equipped to react boxed waste such as biomedical waste. In the absence of air in a molten aluminum alloy the cellulose in a cardboard box rapidly reacts to form some free carbon that comes off in the off gas along with carbon monoxide and hydrogen. The carbon may be filtered off and burned as fuel and the carbon monoxide-hydrogen mixture may also be used for fuel or in larger installations possibly used as synthesis gas. In a typical biomedical waste the glass and hypodermic needles will stay in the aluminum alloy and other components will be completely broken down to elemental form.

In FIG. 4 boxes are pushed through opening 60 with air lock door 68 in the closed position and the first hydraulic ram 62 pushes the box over rollers to the purge chamber 64. The second hydraulic ram in purge door 66 moves downward to close the box in the purge chamber. The purge chamber is purged with argon or other inert gas to remove air (lines and controls not shown) and air lock door 68 opens and the second hydraulic ram on door 66 pushes the box into reactor 2. Air lock door 68 closes and hydraulic ram 70 operates to submerse the box into the molten 71 and the cycle repeats for the next box. A calming chamber 72 to allow a non splash addition of continuously recycled molten alloy is used. The remainder of the numbers in FIG. 4 are as previously discussed.

FIG. 5 shows an off gas treatment process that is sufficient for many different wastes treated. Line 11 will be large enough to handle a surge in gas volume with little pressure increase with relief valve 54 typically set to open with less than one half pound of pressure. Spray nozzles 40 quench the off gas to a temperature of less than 100 degrees centigrade. The cooled gases and quench water with particulates such as carbon therein enter the cyclone separator 44 where the gases and liquid are separated with exit gases going through a wire mesh demister before exiting to the atmosphere or for use as a fuel. With less than 20 foot per second gas velocity going to the demister the wire mesh demister is quite efficient. The aqueous layer with particulates therein is recirculated by pump 46 through a filter system 48 that may be a continous filter or a pair of filters such as the manually emptied manually such as Andale filters depending upon the volume handled. Aqueous filtrate exit the filter system is cooled in a cooler such as air cooler 50 and recycled through line 52 to spray nozzles 40.

What is claimed is:

1. Equipment for molecular decomposition of hazardous wastes comprising:

1) an alloy heating unit means to maintain a molten alloy at a minimum temperature of about 850 degrees centigrade with minimum oxygen contact with said molten metal;

2) a melting chamber to melt a solid aluminum alloy to allow feeding a molten alloy into said alloy heating unit;

3) a minimum of one reactor unit adjacent to said alloy heating unit with insulated line means to allow circulation of said molten alloy between said reactor unit and said alloy heating unit;

4) a submersible molten alloy pumping means in said alloy heating unit to pump said molten alloy through one of said insulated line means to said reactor unit;

5) an overflow means to maintain a constant alloy level in said reactor by allowing gravity flow of said molten alloy through one of said insulated line means to said alloy heating unit;

6) a feed means to feed hazardous waste below said constant alloy level in said reactor;

7) an off gas treatment means to remove particulates and condensibles from off gas from said reactor.

2. Equipment for molecular decomposition of hazardous waste as in claim 1 wherein said feed means to feed a liquid hazardous waste to said reactor comprises:

a) a feed tube extending through a removable top of said reactor through said molten alloy to near a bottom of said molten alloy in said reactor;

b) a baffle plate means suspended from said removable top of said reactor and acting to cause effluent gases that form bubbles at the tip of said feed tube to travel a slanted upward path beneath a series of baffle plates in said baffle plate means thereby causing said bubbles to form, flatten, and reform to secure enhanced surface area contact between said effluent gases and said molten alloy.

3. Equipment for molecular decomposition of hazardous waste as in claim 1 wherein said off gas treatment means comprises an aqueous quench system, a cyclone separator, a demister, a circulating pump, a filter, and an aqueous cooler with off gas feeding into and being cooled below a 100 degrees centigrade in said aqueous quench system; with effluent from said quench system leading to a cyclone separator to separate said off gas into a gas that exits said separator through a demister and a liquid stream containing particulates that drains to feed said circulating pump; said circulating pump circulating through said filter to remove solids and through said aqueous cooler to feed into said aqueous quench system.

* * * * *